US011495425B2

(12) United States Patent
Wölk et al.

(10) Patent No.: US 11,495,425 B2
(45) Date of Patent: Nov. 8, 2022

(54) CIRCUIT BREAKER WITH A MONITORING DEVICE, AND METHOD FOR IT

(71) Applicant: PHOENIX CONTACT GMBH & CO. KG, Blomberg (DE)

(72) Inventors: Gerhard Wölk, Schieder-Schwalenberg (DE); Martin Striewe, Horn-Bad Meinberg (DE); Alexander Fomenko, Bielefeld (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 17/052,294

(22) PCT Filed: Jun. 7, 2019

(86) PCT No.: PCT/EP2019/064921
§ 371 (c)(1),
(2) Date: Nov. 2, 2020

(87) PCT Pub. No.: WO2019/234211
PCT Pub. Date: Dec. 12, 2019

(65) Prior Publication Data

US 2021/0142970 A1 May 13, 2021

(30) Foreign Application Priority Data

Jun. 8, 2018 (BE) ..... 2018/5380

(51) Int. Cl.
*H01H 9/54* (2006.01)
*H01H 47/00* (2006.01)

(52) U.S. Cl.
CPC ..... *H01H 47/002* (2013.01); *H01H 47/001* (2013.01); *H01H 2009/544* (2013.01); *H01H 2047/003* (2013.01); *H01H 2300/052* (2013.01)

(58) Field of Classification Search
CPC ..... H02H 3/16; H02H 3/33; H02H 3/335; H02H 3/334; H02H 3/08; H02H 3/162;
(Continued)

(56) References Cited

U.S. PATENT DOCUMENTS

2007/0086126 A1* 4/2007 Baxter ..... H02H 11/005 361/42
2015/0015998 A1* 1/2015 Bowman ..... H03K 17/08142 361/31

(Continued)

FOREIGN PATENT DOCUMENTS

DE 1151062 7/1963
DE 3135888 3/1983

(Continued)

OTHER PUBLICATIONS

International Search Report and Written Opinion for International (PCT) Patent Application No. PCT/EP2019/064921, dated Sep. 3, 2019, 11 pages.

(Continued)

*Primary Examiner* — Bryan R Perez
(74) *Attorney, Agent, or Firm* — Sheridan Ross P.C.

(57) ABSTRACT

The disclosure relates to a circuit breaker with a monitoring device having an electronic switch and a mechanical changeover switch, where the mechanical changeover switch has a first terminal, a second terminal and a third terminal, where in a neutral position of the mechanical changeover switch the first terminal is connected to the third (Continued)

terminal and where in an operating position of the mechanical changeover switch the second terminal is connected to the third terminal, where the electronic switch is connected to the third terminal of the mechanical changeover switch as a series circuit, where when switching on the circuit breaker in a first switching state, initially the electronic switch is activated, where a measurement is taken at the first terminal using the monitoring device to determine whether essentially the same potential is present at the first terminal as at the third terminal and, it this is the case, the electronic switch is activated and the mechanical changeover switch is in an operating position in a subsequent additional switching state. Furthermore, the disclosure relates to methods for the circuit breaker.

17 Claims, 4 Drawing Sheets

(58) Field of Classification Search
CPC ..... H02H 3/338; H02H 3/05; H02H 3/331; H02H 3/002; H02H 3/00; H02H 3/066; H02H 3/32; H02H 1/0007; H02H 1/0015; H02H 5/047
See application file for complete search history.

(56) References Cited

U.S. PATENT DOCUMENTS

| | | | | |
|---|---|---|---|---|
| 2016/0057841 | A1* | 2/2016 | Lenig ..... | H05B 47/16 315/291 |
| 2016/0087426 | A1 | 3/2016 | Kuranuki et al. | |

FOREIGN PATENT DOCUMENTS

| | | |
|---|---|---|
| DE | 102004036252 | 3/2006 |
| DE | 102006013329 | 10/2007 |
| DE | 102014016218 | 4/2015 |
| DE | 102015121194 | 6/2017 |
| EP | 0938118 | 8/1999 |
| EP | 2503575 | 9/2012 |
| EP | 2587512 | 5/2013 |
| EP | 2787358 | 10/2014 |
| JP | S59-194324 | 11/1984 |
| JP | H01-209613 | 8/1989 |

OTHER PUBLICATIONS

Translation of the International Search Report and Written Opinion for International (PCT) Patent Application No. PCT/EP2019/064921, dated Sep. 3, 2019, 8 pages.

* cited by examiner

CIRCUIT BREAKER WITH A MONITORING DEVICE, AND METHOD FOR IT

CROSS REFERENCE TO RELATED APPLICATIONS

This application is a national stage application under 35 U.S.C. 371 and claims the benefit of PCT Application No. PCT/EP2019/064921 having an international filing date of 7 Jun. 2019, which designated the United States, which PCT application claimed the benefit of Belgium Patent Application No. BE2018/5380 filed 8 Jun. 2018, the disclosures of each of which are incorporated herein by reference in their entireties.

BACKGROUND

The use of electronic circuit breakers is known from diverse areas.

An electrical system having a relay-controlled electric load is known from DE 10 2004 036 252 A1. The relay can be monitored in relation to the load current and supply voltage, i.e., in regard to the connected input. A system and method for monitoring relay contacts is known from DE 10 2014 016 218 A1. In this case, an additional signal emitter is activated and an additional high-frequency signal is evaluated on the two sides of the switch. A safety-oriented switching device with positive guidance is known from the applicant's EP 2 587 512 B1. For example, in positive guidance, the normally closed contact and the additional contacts, the switch contact and/or a normally open contact, are connected to each other in such a manner that the normally closed contact and the normally open contact cannot be closed at the same time. A method for detecting faults in a network system is known from DE 10 2006 013 329 A1. In this system, a defined voltage potential is led to a bus branch by means of an additional switching means in order to detect the disconnected state of a relay. Furthermore, a device having an integrated protection profile is known from DE 10 2015 121 194 A1, wherein the electronic switch is controlled on the basis of a certain current.

Galvanically isolating circuit breakers are also used in many areas of electrotechnical systems. In these circuit breakers, the output is designed to be galvanically isolated when in a switched-off state.

PRIOR ART

Therefore, for example, electronic circuit breakers are used whose galvanic isolation is provided via a relay.

However, mechanical contacts as used in relays have the property that the switching contacts can stick/weld together so that secure galvanic isolation is no longer possible.

Unfortunately, with the circuit breakers to date, a user is unable to detect whether the galvanic isolation is assured without undertaking a separate measurement on the device—sometimes in connection with a shutdown.

OBJECT

Accordingly, an object of the invention is to provide a circuit breaker having a monitoring device and method therefor which enable the detection of a loss of galvanic isolation.

SOLUTION

The object is achieved by means of a circuit breaker having a monitoring device according to claim 1 and by means of a method according to claim 11. Additional advantageous embodiments of the invention are indicated in the respective dependent claims, the description and the drawings.

BRIEF DESCRIPTION OF THE DRAWINGS

The invention is explained in greater detail below using preferred embodiments with reference to the attached drawing.

The invention will be described in greater detail below (with reference to the drawings). It should be noted that various aspects are described which can be used individually or in combination. This means that any given aspect can be used with various embodiments as long as it is not explicitly represented as a mere alternative.

Also, for simplicity's sake and as a rule, reference will always be made below to only one entity. However, unless noted otherwise, the invention may also have several of any of the entities in question. To that extent, the use of the words "a" and "an" are to be understood only as an indication that at least one entity is being used in a single embodiment.

To the extent that methods are described hereinafter, the individual steps of a method can be arranged and/or combined in any sequence as long as the context does not explicitly provide otherwise. Furthermore, the methods can be combined with one other unless expressly indicated otherwise.

As a rule, specifications having numerical values are not to be understood as exact values, but as having a tolerance of +/−1% to +/−10%.

References to standards or specifications or norms shall be understood to be references to standards or specifications or norms which are or were valid at the time of the application or—if a priority is claimed—at the time of the priority filing. However, this shall not be understood as a general exclusion of the applicability of subsequent or superseding standards or specifications or norms.

Hereinafter, "adjacent" explicitly includes a direct proximity relationship without, however, being limited to it, and "between" explicitly includes a position in which the intermediate part is in direct proximity to the surrounding parts.

Particularly in the process industry, a galvanically isolating circuit breaker is frequently required which switches off the output in an overload and/or short-circuit situation.

Figure 1:
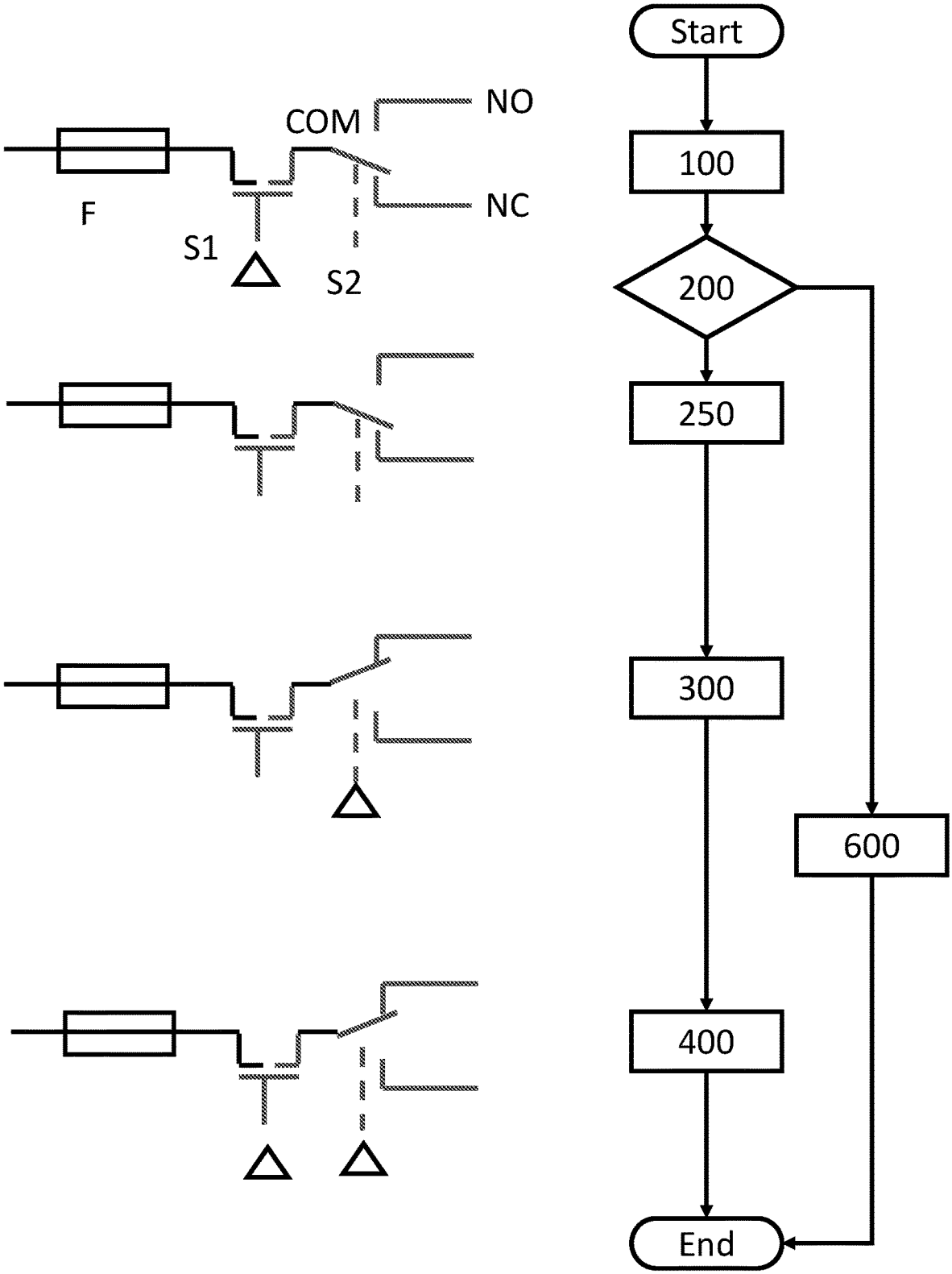
FIG. 1 shows a side-by-side arrangement of schematic equivalent circuit diagrams regarding the method steps according to the embodiments of the invention.
Figure 2:
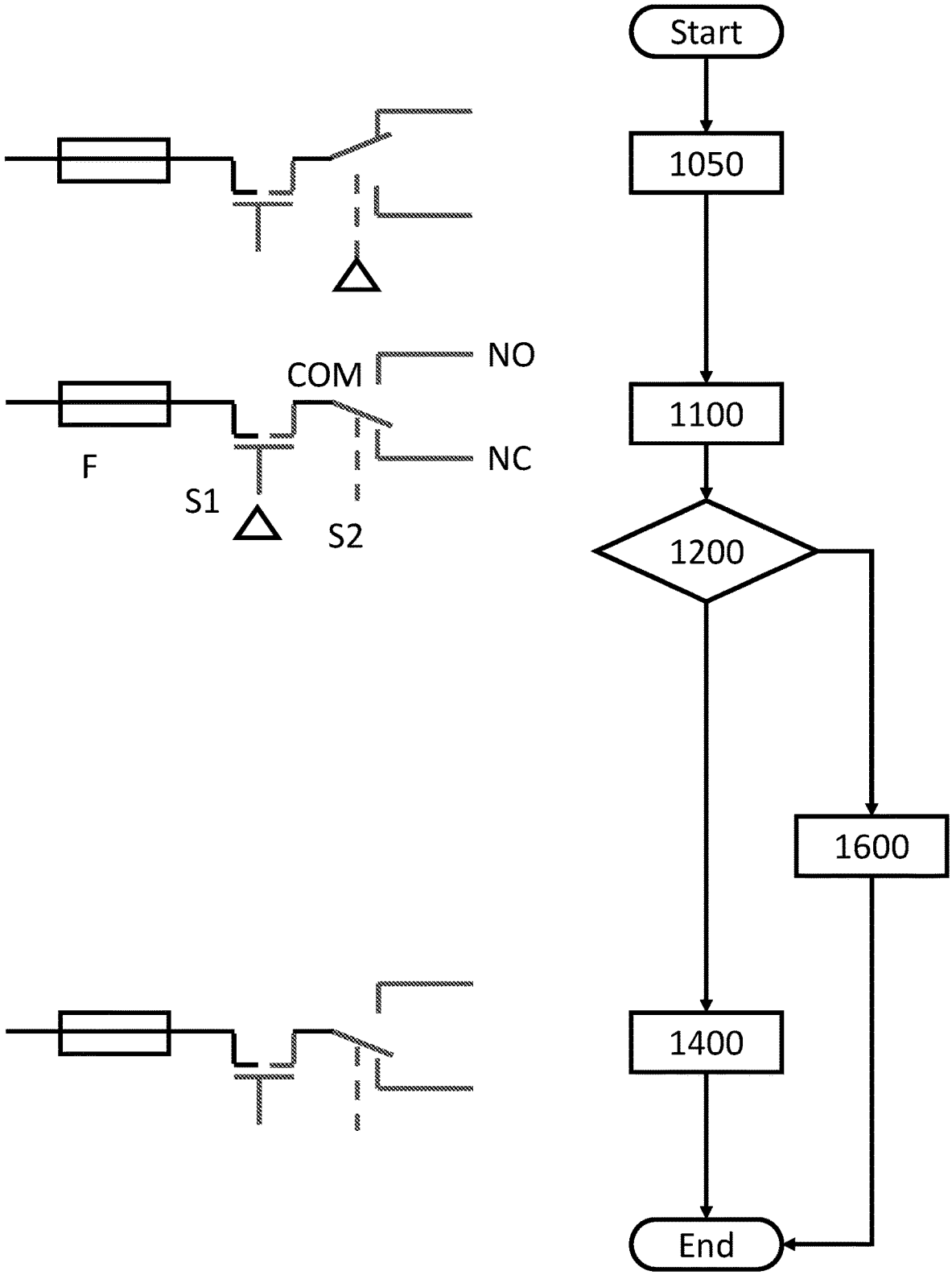
FIG. 2 shows a side-by-side arrangement of schematic equivalent circuit diagrams regarding the method steps according to the embodiments of the invention.
Figure 3:
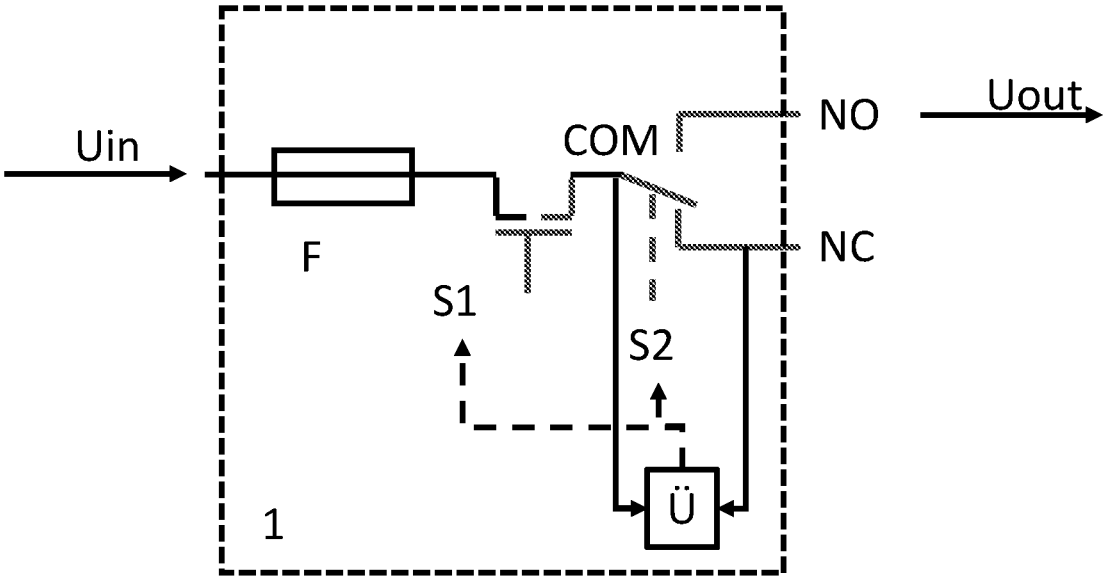
FIG. 3 shows a schematic illustration of an equivalent circuit diagram according to one aspect of the invention.
Figure 4:
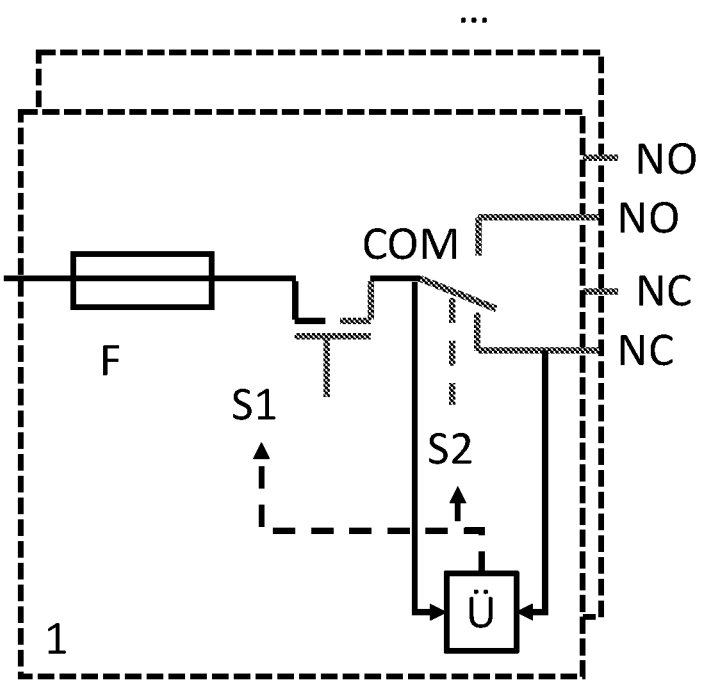
FIG. 4 shows a schematic illustration of an equivalent circuit diagram according to an additional aspect of the invention.
Figure 5:
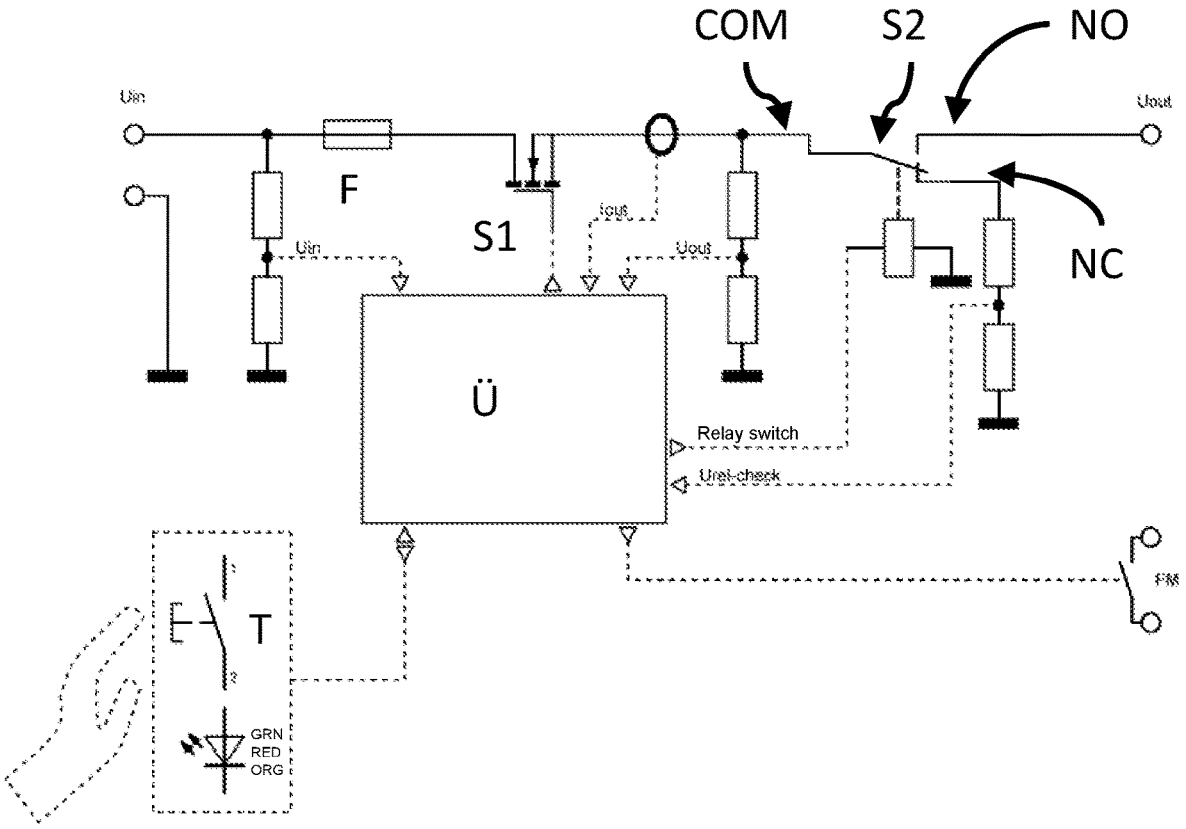
FIG. 5 shows an additional schematic illustration of an equivalent circuit diagram according to an embodiment of the invention.

Illustrative electrical equivalent circuit diagrams according to the embodiments of the invention are depicted in FIGS. 3-5. FIGS. 1 and 2 depict simplified equivalent circuit diagrams next to corresponding method steps.

A circuit breaker 1 according to the invention having a monitoring device Ü has at least one electronic switch S1 and one mechanical change-over switch S2. The electronic switch S1 may be, for example, a switching transistor, particularly a field effect transistor.

Without limiting generality, it may be provided that multiple connected outputs Uout can also be arranged on one input voltage Uin, as indicated in FIG. 4. Hereinafter, for ease of understanding the invention, it will be assumed that there is one output Uout, which can be controlled by the circuit breaker 1, per input Uin.

The mechanical changeover switch S2, e.g. a relay, has a first terminal NC, a second terminal NO and a third terminal COM, wherein in a neutral position of the mechanical changeover switch S2, the first terminal NC is connected to the third terminal COM and wherein in an operating position of the mechanical changeover switch S2, the second terminal NO is connected to the third terminal (COM). This means that S2 may be constructed as a relay having a changeover contact.

The electronic switch S1 is connected to the third terminal COM of the mechanical changeover switch S2 as a series circuit. A direct sequence may also be provided here as a series circuit with additional (intermediate) components.

When switching on the circuit breaker 1 in a first switching state, the electronic switch S1 is initially activated, wherein a measurement is performed at the first terminal NC by means of the monitoring device Ü to determine whether the same potential is essentially present at the first terminal NC as on the third terminal COM.

This can be achieved, for example, by one voltage divider being arranged at the third terminal COM and one at the first terminal NC, each said voltage divider providing a voltage Uout, Urel check for direct comparison purposes (e.g., at the input of a differential operational amplifier) or for indirect comparison purposes (e.g., after A/D conversion by comparing the numerical values). Naturally, a voltage divider can also be omitted given a suitable voltage, and the respective voltages supplied directly for analysis. Without limiting generality, additional components, e.g., capacitors, ferrite cores and so on, may naturally also be provided to make other properties available. However, these are not relevant for understanding the invention and are therefore omitted.

If essentially the same potential is applied to the first terminal NC as at the third terminal COM, the electronic switch S1 may be activated and the mechanical changeover switch S2 may be in the operating position in a subsequent additional switching state.

This means that by verifying the voltage at the first terminal compared to the third terminal, it is now possible to determine whether the changeover contact COM of the mechanical switch is stuck, because it is now possible to determine whether the changeover contact of S2 has detached from the second terminal NO or not. This is achieved by the fact that given a changeover contact that is welded or stuck together, an essentially different potential is present at the first terminal NC than on the third terminal COM.

A corresponding method will now be explained by means of FIG. 1 for a switch-on situation. In other words, in this method, a check is performed prior to continuous activation whether the contact is stuck/welded together, and thus whether galvanic isolation is no longer present in the event of disconnection.

It is assumed here that the circuit breaker 1 is designed as before. In a step 100, the electronic switch S1 is now initially activated. This is symbolized by a triangle in the symbolic representation of the equivalent circuit diagram. Then, the status of the non-activated, i.e., not actively controlled, mechanical switch S2 is determined. To this end, in a subsequent step 200, the monitoring device Ü verifies whether essentially the same potential is present at the first terminal NC as at the third terminal COM, and if this is the case, the electronic switch S1 is subsequently activated in a step 400 and the mechanical changeover switch S2 is placed in the operating position in step 300.

In one embodiment of the invention, in the event of a fault, i.e., if in the first switching state essentially the same potential fails to be present at the first terminal NC as at the third terminal COM when switching on, a fault status is signaled by means of a warning device W. For example, in FIG. 1, a fault status can be signaled by means of a warning device W in step 600. Thereafter, depending on the application and configuration, continuous activation can be stopped as shown or activation is possible with a warning (by the warning device W or after remote signaling) and/or by means of an explicit release (e.g., by confirmation using a pushbutton T).

In another embodiment of the invention, the warning device W has a signal light and/or an acoustic warning device and/or remote signaling (FM). Without limiting generality, the warning device W can also be combined with other devices. For example, FIG. 5 shows how the warning device can also be implemented together with a pushbutton T, e.g. an illuminated pushbutton.

Even though the steps 300 and 400 are represented separately and in a chronological sequence, this does not have to be the case. Instead, the steps may be executed in any sequence as well as simultaneously.

However, the chronologically depicted sequence of the steps has an advantage in that the mechanical switch S2 can be preferably switched in a load-free manner, so that for example electric arcs, which can lead to contact welding/sticking, can be avoided. To this end, in an additional, intermediate switching state between the first switching state and the additional switching state, the circuit breaker 1 can turn off electronic switch S1 to enable a currentless switchover of the mechanical changeover switch S2 into an operating position. In other words, prior to placing the mechanical changeover switch S2 into an operating position in step 300, the electronic switch S1 can first be turned off in step 250 to enable a currentless switchover of the mechanical changeover switch S2 into an operating position.

Even though the circuit breaker 1 above was described only in relation to a switch-on process, the circuit breaker 1 can also be checked for sticking/welding together in a similar manner when switched off. This will be explained below. The methods for monitoring the switch-on/switch-off process can thereby be used in a basically independent, chronologically sequential manner.

When switching off circuit breaker 1, the mechanical changeover switch S2 is initially deactivated in a first switching state. Then, by means of the monitoring device Ü, a measurement is performed at the first terminal NC to determine whether essentially the same potential is present at the first terminal NC as at the third terminal COM. If this is the case, in a subsequent switching state the electronic switch S1 can be deactivated and the mechanical changeover switch S2 can be in a neutral position.

This means that it is now possible to determine, by checking the voltage at the first terminal in comparison to the third terminal, whether the changeover contact COM of the mechanical changeover switch S2 is stuck, because it is now possible to determine whether the changeover contact of S2 has detached or not from the second terminal NO. This is achieved by the fact that, given a welded/stuck changeover contact, an essentially different potential is present at the first connector NC than at the third terminal COM.

A corresponding method will now be explained using FIG. 2 for a switch-off situation. In other words, in this method, prior to switching off permanently, a check is performed to see whether the contact is stuck/welded together, and galvanic isolation thus no longer present when switching off.

It is assumed here that the circuit breaker 1 is switched off as before. In a first step 1100, the mechanical changeover switch S2 is deactivated. Then in step 1200, by means of the monitoring device Ü, one can check whether essentially the same potential is present at the first terminal NC as at the third terminal COM. If this is the case, both the electronic switch S1 can be deactivated in step 1400 and the mechanical changeover switch S2 can be left in the neutral position.

In one embodiment of the invention, if essentially the same potential fails to be present at the first terminal NC as at the third terminal COM, a fault condition can be signaled by means of a warning device W, e.g. in a step 1600. This warning device W can be independent or be the same warning device W as described earlier in relation to the switch-on process. Furthermore, the circuit breaker 1 may also have remote signaling for this fault situation.

However, the chronologically depicted sequence of steps has an advantage in that the mechanical switch S2 can be preferably switched in a load-free manner, so that for example electric arcs, which can result in contact welding/sticking, can be prevented. To this end, the electronic switch S1 can be switched off by the circuit breaker 1 in an intermediate step 1050 prior to the deactivation 1100 of the mechanical changeover switch S2 to enable a currentless switchover of the mechanical changeover switch S2 into an operating position.

Without limiting generality, the circuit breaker may also have a fusible-wire fuse F, wherein the fusible-wire fuse F is connected in series to the electronic switch S1 and the third terminal COM of the mechanical changeover switch S2. This fusible fuse F may be triggered in an overload situation, for example.

Furthermore, as indicated in FIG. 4, the mechanical changeover switch S2 may also have one or more mechanically connected but electrically insulated switchable poles. In other words, by monitoring at least one pole of the mechanical changeover switch S2, one can also determine the galvanic isolation status of a plurality of mechanically connected poles. Naturally, each individual pole can also be monitored separately.

This means that the invention makes use of the "normally closed" contact of the relay as a measuring input at certain points in time to query whether the galvanic isolation is assured. In a fault situation, for example in an over-current situation (Iout) or an over-voltage situation Uin/Uout/Urel check, the user can be informed of the fault situation and/or continued operation can be stopped.

If, by means of the circuit breaker, a channel from Uin to Uout is switched on by the user (e.g., by pressing the pushbutton T once), the electronic switch S1 can be switched through and a measurement made at the "normally closed" contact NC of the mechanical switch S2 to see whether voltage is present. If voltage is present, it can be concluded that the switching contact of the mechanical switch S2 is not welded in the NO position. The electronic switch S1 can now be switched off and if the mechanical switch S2 is fault-free, the mechanical switch S2 can be switched on in a currentless manner. The electronic switch S1 can subsequently be switched on and the output Uout is in operation (permanently until being switched off). If no voltage is present, the electronic switch S1 is switched off and the user can be signaled that the output is not galvanically isolated (contact is welded in the NO position).

On the other hand, if a user uses the circuit breaker to switch off a channel from Uin to Uout (e.g., by pressing pushbutton T once), the electronic switch S1 initially interrupts the current flow. The mechanical switch S2 is then also switched off (e.g., by the monitoring device Ü). In a next step, the electronic switch S1 switches on again and a measurement is performed at the "normally closed" contact NC. Then the electronic switch S1 is switched off again. If voltage was present during measurement, a change of the switch position on the mechanical switch S2 had taken place and galvanic isolation is assured. In a fault situation, the user can be signaled that the output is not galvanically isolated (contact is welded in the NO position).

Without limiting generality, the monitoring device Ü can be made available in a variety of ways. For example, the monitoring device Ü can be provided by a suitable microcontroller/microprocessor/FPGA/ASIC. In particular, the monitoring device Ü can also identify a current Iout through the circuit breaker 1, particularly also through the electronic switch S1, to detect an overload situation, for example. Furthermore, the monitoring device can also provide short-circuit monitoring.

The measuring input(s) at the monitoring device Ü may be designed differently. The voltage can be measured by means of a voltage divider and the analog value can be further analyzed. Alternatively, the switching state can be detected digitally at a digital input and analyzed.

In the event of a fault, suitable measures can indicate that the fault occurred while switching on or switching off. For example, the remote signaling device FM may also be a digital interface that provides corresponding switch positions/fault notifications. At the same time, the remote signaling device FM may also be designed in such a manner that the circuit breaker 1 can also be remotely operated by means of the remote signaling device FM.

LIST OF REFERENCE SIGNS

1 Circuit breaker
F Fusible-wire fuse
Ü Monitoring device
NO Normally-open contact
NC Normally-closed contact
COM Common contact
T Pushbutton
FM Remote signaling
S1 Switch, electronic
S2 Switch, mechanical
W Warning device
Uin Input voltage
Uout Output voltage
Urel check NC output voltage
relay switch Switching signal for mechanical switch
Iout Current passing through circuit breaker

The invention claimed is:

1. A circuit breaker, comprising:
a monitoring device,
an electronic switch, and
a mechanical changeover switch including a first terminal, a second terminal, and a third terminal, wherein in a neutral position of the mechanical changeover switch the first terminal is connected to the third terminal, wherein in an operating position of the mechanical changeover switch the second terminal is connected to the third terminal, wherein the electronic switch is connected to the third terminal of the mechanical changeover switch as a series circuit, wherein when switching on the circuit breaker to a first switching state the electronic switch is initially activated and a measurement is taken at the first terminal using the monitoring device to determine whether essentially the same potential is present at the first terminal as at the third terminal and, if this is the case, the circuit breaker switches to a subsequent additional switching state where the electronic switch is activated and the mechanical changeover switch is in the operating position.

2. The circuit breaker according to claim 1, wherein between the first switching state and the subsequent additional switching state, the electronic switch is switched off to enable a currentless changeover of the mechanical changeover switch to the operating position.

3. The circuit breaker according to claim 1, further comprising a fusible-wire fuse, wherein the fusible-wire fuse is connected in series to the electronic switch and the third terminal of the mechanical changeover switch.

4. The circuit breaker according to claim 1, wherein the mechanical changeover switch includes one or more mechanically connected, but electrically insulated switchable poles.

5. The circuit breaker according to claim 1, wherein the electrical switch is connected between an input of the circuit breaker and the mechanical changeover switch.

6. The circuit breaker according to claim 1, wherein if, in the first switching state, essentially the same potential fails to be present at the first terminal as at the third terminal, a fault condition is signaled by a warning device.

7. The circuit breaker according to claim 6, wherein the warning device has a signal light and/or an acoustic warning device and/or remote signaling.

8. The circuit breaker according to claim 1, wherein when switching off the circuit breaker, first the mechanical changeover switch is deactivated, and at the first terminal, a monitoring device measures whether essentially the same potential is present at the first terminal as at the third terminal and, if this is the case, the electronic switch is deactivated and the mechanical changeover switch is switched to the neutral position.

9. The circuit breaker according to claim 8, wherein if, in the first switching state, essentially the same potential fails to be present at the first terminal as at the third terminal, a fault condition is signaled by a warning device.

10. The circuit breaker according to claim 9, wherein the warning device has a signal light and/or an acoustic warning device and/or remote signaling.

11. The circuit breaker according to claim 8, wherein between the first switching state and the subsequent additional switching state, the electronic switch is switched off to enable a currentless switchover of the mechanical changeover switch the operating position.

12. A method for a circuit breaker that includes a monitoring device, an electronic switch, and a mechanical changeover switch, wherein the mechanical changeover switch has a first terminal, a second terminal and a third terminal, wherein in a neutral position of the mechanical changeover switch, the first terminal is connected to the third terminal, and wherein in an operating position of the mechanical changeover switch, the second terminal is connected to the third terminal, wherein the electronic switch is connected to the third terminal of the mechanical changeover switch as a series circuit, the method comprising the following steps when switching on the circuit breaker in a first switching state:

activating the electronic switch; and verifying with the monitoring device whether essentially the same potential is present at the first terminal as at the third terminal and, if this is the case, activating the electronic switch and placing the mechanical changeover switch in the operating position.

13. The method according to claim 12, further comprising the following steps when switching off the circuit breaker:

deactivating the mechanical changeover switch and verifying by of the monitoring device whether essentially the same potential is present at the first terminal as at the third terminal and, if this is the case, deactivating the electronic switch and leaving the mechanical changeover switch in the neutral position.

14. The method according to claim 13, wherein if, when switching off, essentially the same potential fails to be present at the first terminal as at the third terminal, a fault condition is signaled by means of a warning device.

15. The method according to claim 13, wherein prior to deactivating the mechanical changeover switch, the electronic switch is switched off to enable a currentless switchover of the mechanical changeover switch to the operating position.

16. The method according to claim 12, wherein if essentially the same potential fails to be present at the first terminal as at the third terminal, a fault condition is signaled by warning device.

17. The method according to claim 12, wherein prior to placing the mechanical changeover switch in the operating position, the electronic switch is switched off to enable a currentless switchover of the mechanical changeover switch to the operating position.

* * * * *